United States Patent [19]

Novey

[11] 4,037,135

[45] July 19, 1977

[54] SOLID STATE TIMER-STEPPER WITH SOFT SWITCH-ON AND SWITCH-OFF LOAD CONTROL

[75] Inventor: William E. Novey, Newhall, Calif.

[73] Assignee: Eli Bridge Company, Jacksonville, Ill.

[21] Appl. No.: 692,279

[22] Filed: June 3, 1976

[51] Int. Cl.[2] ..... G05F 1/00; H05B 37/02; H05B 39/02

[52] U.S. Cl. ..... 315/194; 307/252 B; 315/195; 315/291; 315/360; 323/24; 323/25; 328/75

[58] Field of Search ..... 315/194, 195, 199, 324, 315/291, 323, 360; 307/252 N, 252 B, 252 UA, 262, 24, 29, 31–35, 37–41; 328/70, 75, 155; 323/18, 19, 23–25

[56] References Cited

U.S. PATENT DOCUMENTS

| | | | |
|---|---|---|---|
| 3,500,174 | 3/1970 | Ellerbeck | 323/24 |
| 3,612,945 | 10/1971 | Stevens | 315/205 |
| 3,778,676 | 12/1973 | Keller | 315/217 |
| 3,781,604 | 12/1973 | Scarpino | 315/323 |
| 3,821,634 | 6/1974 | Sabolic | 307/252 B |
| 3,859,591 | 1/1975 | Saunders | 307/252 UA |
| 3,896,369 | 7/1975 | Nakata | 307/252 B |
| 3,898,516 | 8/1975 | Nakasone | 315/199 |
| 3,911,331 | 10/1975 | Jamieson | 328/75 |
| 3,940,660 | 2/1976 | Edwards | 315/199 |
| 3,952,242 | 4/1976 | Ukai | 307/252 N |
| 4,008,416 | 2/1977 | Nakasone | 315/194 |
| 4,010,412 | 3/1977 | Forman | 323/25 |

*Primary Examiner*—Stanley D. Miller, Jr.
*Attorney, Agent, or Firm*—William A. Snow; John Diver

[57] ABSTRACT

A timer-stepper, which is particularly applicable to light chasers for producing a special "ripple" lighting effect and increasing bulb and logic circuit component lives, having photoncoupler phase-shifting networks in the gate circuits of switching triacs for "softness" during switching and for isolating the logic of said timer-stepper from A.C. line or switching transients.

5 Claims, 5 Drawing Figures

SOLID STATE TIMER-STEPPER WITH SOFT SWITCH-ON AND SWITCH-OFF LOAD CONTROL

BACKGROUND OF THE INVENTION

Light action control is one of may facets of timing and program control technology. Special fade-in, fade-out and dwell lighting effects for signs, displays, exhibits, wherever a variable-speed, multiple-circuit timer can serve to control the lights of theatre marquees, window displays and trade show exhibits, use the hypnotic effect of light-in-motion to lure customers, to attract visitors to a convention booth, or to draw attention to the sales message of an advertising sign.

These exhibit-displays, when used in the chaser mode, have been controlled in the past by electromechanical timers which are motor-driven and have cam-actuated, heavy silver electrical contacts which bounce, stick and wear out. They are expensive, explosion-prone and offer no protection against large lamp in-rush currents following lamp switch-on. Switching by electromechanical timers is invariably hard on bulbs The subject matter of the present invention concerns switching of light bulbs in A.C. circuits. Switch-on and switch-off control of light bulbs is to be distinguished from fade-in and fade-out control of the same which concerns those special lighting effects, individually custom-suited to fit any one particular requirement. For example, theaters and night clubs use dimmers to fade out house lights and fade in footlights, spotlights or stage lights. Dimmers are blended to synchronize light with motion and sound.

Uncontrolled switch-on and switch-off of lamp by electromechanical or solid state means, regardless of the voltage amplitude being applied to the lamp at that instant, can be damaging to lamp life if done at or near A.C. peak voltage on a repetitive basis. For this reason, lamp-driving circuits for light chasers, etc., have expensive zero-voltage crossover detection circuitry and triggering devices to produce soft switching.

There is presently a need for a low-cost solid state timer-stepper which provides for soft-switching control of the triacs and isolation of the control logic from A.C. line or triac transient, and which in a light-chaser application produces a special "ripple" lighting effect.

SUMMARY OF THE INVENTION

The gist of this invention lies in combining an A.C. phase-shift network in the triac gating circuit of a timer-stepper having conventional clock counter and decoder control logic, and floating logic D.C. ground with a single-phase center-tap A.C. rectifier circuit A.C. power supply so that said D.C. ground is not connected to A.C. load neutral. The phase-shift network comprises a photoncoupler having a photocell component which exhibits slow rise and decay characteristics such that the di/dt of the gate signal increases from one A.C. cycle to the next, beginning with the first increasing A.C. voltage cross-over after the application of a D.C. voltage pulse from the decoder output. This triggers the A.C. voltage applied by the triac to the lamp load circuit at increasingly earlier phase angles relative to decreasing A.C. voltage cross-over from one cycle to the next for a soft switch-on condition, and decreases the di/dt of the gate signal such that the A.C. voltage applied to the lamp load circuit comes at increasingly later phase angles from one cycle to the next after the removal of the D.C. voltage pulse from the decoder for a soft switch-off condition.

DESCRIPTION OF THE DRAWINGS

FIG. 2(*b*) shows pulse output from clock of the control logic of FIG. 1 on the A.C. cycle time basis of FIG. 2(*a*);

FIG. 2(*d* 1, 2, 3, 4, 5) shows voltage pulse output for each of the channels of the decoder of the control logic of FIG. 1 on the A.C. cycle time basis of FIG. 2(*a*);

FIG. 2(*e* 1, 2, 3, 4, 5) shows triac gate signals for each of the channels of the control logic of FIG. 1 on the A.C. cycle time basis of FIG. 2(*a*);

FIG. 2(*f* 1, 2, 3, 4, 5) shows the phase-controlled triac voltage waveforms applied to the lamps of the chaser of FIG. 1 on the A.C. cycle time basis of FIG. 2(*a*);

FIG. 3(*c* B, C, D) shows binary coded decimal outputs from the counter of the control logic of FIG. 1 on same A.C. cycle time basis as FIG. 3(*b*);

FIG. 3(*d* 1, 2, 3, 4, 5) shows voltage pulses for each of the channels of the decoder of the control logic of FIG. 1 on same A.C. cycle time basis as FIG. 3(*b*);

FIG. 3(*e* 1, 2, 3, 4, 5) shows triac gate signals for each of the channels of the control logic of FIG. 1 on same A.C. cycle time basis as FIG. 3(*b*);

FIG. 3(*f* 1, 2, 3, 4, 5) shows the phase-controlled triac voltage waveforms applied to lamps of the chaser of FIG. 1 on same A.C. cycle time basis as FIG. 3(*b*);

DESCRIPTION OF THE PREFERRED EMBODIMENT

In the following specification, the power supply connections to building blocks of the power supply and control circuits are not shown but are presumed operationally connected to a power source in the standard practice of the trade. The phrase "building block" as used in this context means NAND, AND, NOT, RSFF, JKFF, TRANSISTOR, COMPARATOR or OPERATIONAL AMPLIFIER in the customary usage of these terms in the industry.

Figure 1:
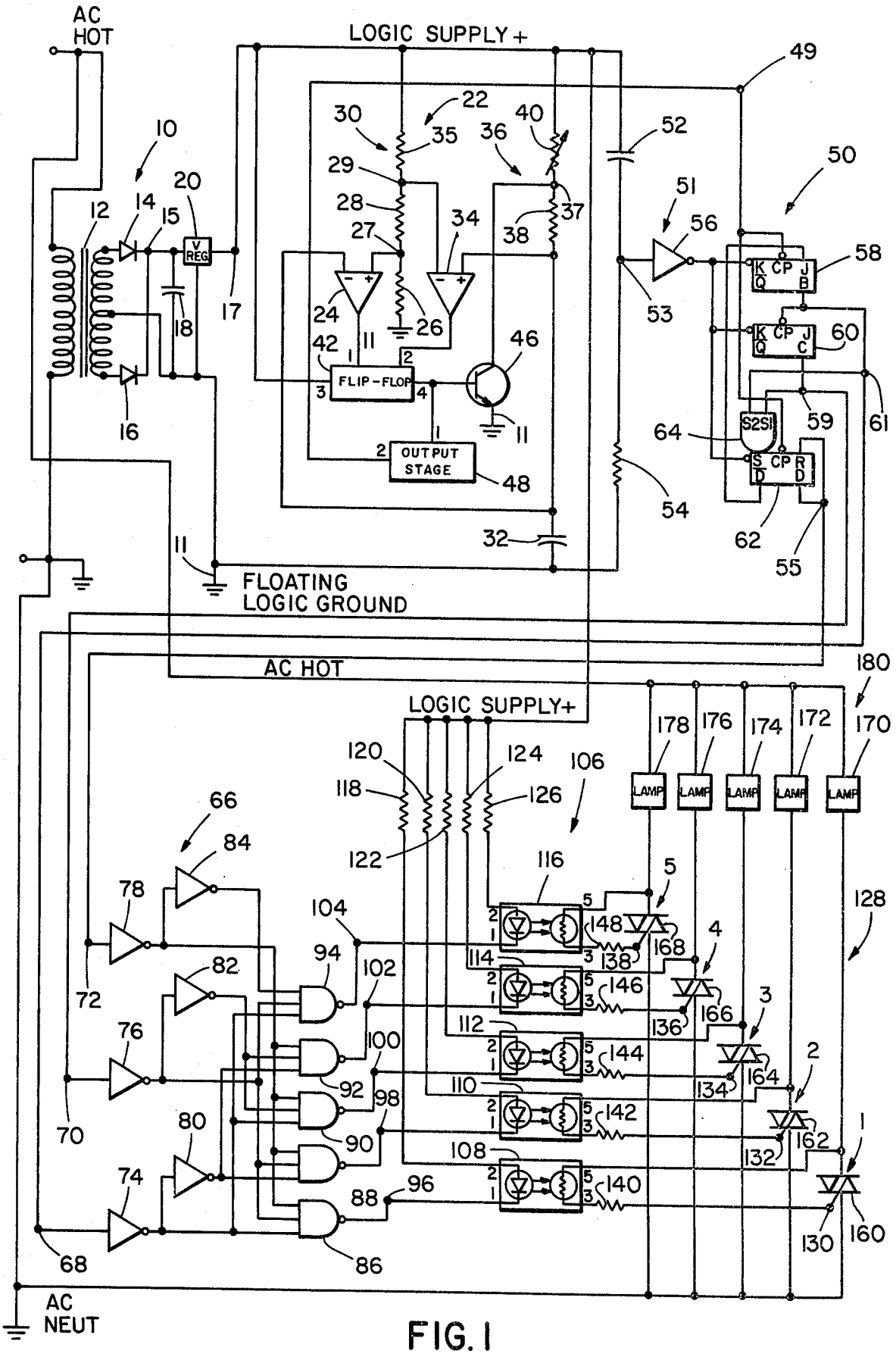
FIG. 1 shows the control logic, the phase-shift network and the A.C. and D.C. power supply circuit for the 5-channel light chaser of this invention having soft switch-on and switch-off of lamps 170, 172, 174, 176 and 178 in chase sequence, as between channel 1, 2, 3, 4 and 5.

Reference to FIG. 1 shows a control logic D.C. power supply 10 for this 5-channel chaser lighting display of this invention comprising a single phase, 120/16-volt, 60 ma center-tapped transformer 12 with the input trminals of its primary coil operationally connected to the terminals of a 120-volt A.C. power source, one terminal of which is operationally connected A.C. "hot," the other operationally connected A.C. "neutral."

Two 30-volt, 500 ma diodes, 14 and 16, each having the terminals of their respective anodes operationally connected to corresponding output terminals of the secondary coil of said transformer 12, have the terminals of each of their cathodes operationally connected to a 5-volt (D.C.) 500 ma unregulated control logic power supply 15. The center-tap of the secondary coil of said transformer 12 operationally connects to logic supply zero or floating logic ground 11. Floating logic ground 11 is not operationally connected to A.C. neutral so that line transients in the 120-volt A.C. power source do not enter the system. A 500 uf, 15-volt electrolytic capacitor 18 of the polarized type operationally connects the terminal of its dielectric-coated electrode to the logic supply 15 and its other electrode to logic supply zero bus 11 for filtering the unregulated logic supply 15. A 5-volt (D.C.), 500 ma, three-terminal voltage regulator 20 operationally connects its number 1 input terminal to the dielectric-coated electrode terminal of the capacitor 18 for establishing a 5-volt (D.C.) regulated logic power supply 17 at its number 3 output terminal from said control logic D.C. power supply circuit 10.

A clock timer circuit 22, for providing an output train of electrical clock pulse signals, operationally connects to the 5-volt (D.C.) regulated control logic power supply 17 of the circuit 10 and comprises a floating-logic grounded trigger comparator 24 having its $V_{cc}$ power supply terminal (not shown) connected to the 5-volt (D.C.) regulated control logic power supply 17 and its positive input terminal operationally connected to a junction terminal 27 between first and second resistors 26 and 28 of a voltage divider circuit 30, the terminal at the other end of resistor 26 being operationally connected to the floating-logic ground 11. The negative trigger terminal of said comparator 24 operationally connects to floating logic ground 11 through the dielectric-coated electrode terminal of a 2 uf, 4-volt electrolytic capacitor 32 of the polarized type.

A floating-logic grounded threshold comparator 34 having its $V_{cc}$ power supply terminal (not shown) connected to the 5-volt (D.C.) regulated control logic power supply 17 operationally connects its negative input terminal to a junction terminal 29 between second and third resistors 28 and 35 of the voltage divider circuit 30, the other end of resistor 35 being operationally connected to said 5-volt (D.C.) regulated control logic power supply 17. The positive threshold terminal of said comparator 34 operationally connects to floating logic ground 11 through the dielectric-coated electrode terminal of the 2 uf, 4-volt electrolytic capacitor 32 and to the 5-volt (D.C.) regulated control logic power supply 17 through series-connected fourth resistor 38 and variable resistor 40 of a resistance-capacitance circuit 36.

A floating-logic grounded flip-flop 42 having its $V_{cc}$ power supply terminal (not shown) connected to the 5-volt (D.C.) regulated control logic power supply 17 operatively connects its number 1 and 2 input terminal to each of the output terminals of said trigger comparator 24 and threshold comparator 34, respectively. The reset terminal number 3 of said flip-flop 42 operationally connects to 5-volt (D.C.) regulated control logic power supply plus bus 17.

An NPN transistor 46 operationally connects its collector terminal to a juncture terminal 37 of series-connected fourth resistor 38 and variable resistor 40, and its emitter terminal to floating-logic ground 11. The other end of fourth resistor 38 operationally connects to the dielectric-coated electrode terminal of capacitor 32. The other end of variable resistor 40 operationally connects to the 5-volt (D.C.) regulated control logic power supply 17. The TTL totem pole output stage 48 operationally connects its number 1 terminal to the number 4 terminal of said flip-flop 42 for establishing the train of clock pulses at an output terminal 49 from said clock 22.

A reset-to-zero circuit 51 comprises a 10 uf, 5-volt electrolytic capacitor 52 of the polarized type which operationally connects its dielectric-coated electrode terminal to the 5-volt (D.C.) regulated control logic power supply 17 and the terminal at its other electrode through a sixth resistor 54 to floating-logic ground 11. An inverter 56 operationally connects its input to a juncture terminal 53, which is operationally connected through the other electrode terminal of the capacitor 52 to the 5-volt (D.C.) regulated control logic power supply 17 and through a sixth resistor 54 to floating-logic ground 11 for the purpose of reset of a counter circuit 50 when power is first applied to the clock 22.

The counter circuit 50, providing for the automatic counting-out of the 5-segment lighting display in sequence from 0 to 4 in binary code in response to an input of a train of clock pulses from the clock 22, comprises a first floating-logic grounded JK flip-flop 58 having its direct reset terminal operationally connected to the output terminal from the inverter 56 and its clock pulse CP input terminal operationally connected to the output terminal 49 from said clock 22. A second floating-logic grounded JK flip-flop 60 also has its direct reset terminal operationally connected to the output terminal from the inverter 56 and its clock pulse CP input terminal operationally connected to the Q output terminal of the first JK flip-flop 58. A floating-logic grounded RS flip-flop 62 has its direct reset terminal operationally connected to the output terminal from inverter 56, its clock pulse CF input terminal operationally connected to the output terminal 49 from the clock 22, its S input terminal operationally connected through the output terminal of a 2-input AND gate 64 of which the input terminal S1 thereof operationally connects to the Q output terminal of the JK flip-flop 60 forming output C terminal 59 from the counter 50. The other input terminal S2 of the AND gate 64 operationally connects to the Q output terminal of the JK flip-flop 58 forming output B terminal 61 from the counter 50. The $\overline{D}$ output terminal of RS flip-flop 62 operationally connects to the J input terminal of the JK flip-flop 58, and its R input and D output terminals operationally connect in common forming output D terminal 55 from the counter 50.

Changing from counter 50 B,C,D output terminology to conventional decoder 66 A,B,C input terminology, although it is entirely possible to use A,B,C in the counter 50, decoder 66, which converts the 3-BIT binary code from the counter circuit 50 to a digital format suitable for the gated driving of the 5-channel light-chaser in sequence, comprises input A terminal 68, input B terminal 70 and input C terminal 72, each operationally connected to output B terminal 61, output C terminal 59 and output D terminal 55 of the counter 50, respectively. A first inverter 74 operationally connects its input terminal to the input A terminal 68, a second inverter 76 operationally connects its input terminal to the input B terminal 70 and a third inverter 78 operationally connects its input terminal to the input C terminal 72. A fourth inverter 80 operationally connects its input terminal to the output terminal of the first inverter 74, a fifth inverter 82 operationally connects its input terminal to the output terminal of the second inverter 76 and a sixth inverter 84 operationally connects its input terminal to the output terminal of the third inverter 78.

In the decoding circuit 66, a first 3-input NAND gate 86 operationally connects its input 1 terminal to the output terminal from inverter 74, a second 3-input NAND gate 88 operationally connects its input 1 terminal to the output terminal from inverter 80, a third 3-input NAND gate 90 operationally connects its input 1 terminal to the output terminal from inverter 74, a fourth 3-input NAND gate 92 operationally connects its input 1 terminal to the output terminal of inverter 80, a fifth 3-input NAND gate 94 operationally connects its input 1 terminal to the output terminal of inverter 74. Input 2 terminals on NAND gates 86, 88 and 94 operationally connect in common to the output terminal of inverter 76. Input 3 terminals on NAND gates 86, 88, 90 and 92 operationally connect in common to the output of inverter 78. Input 2 terminals on NAND gates 90 and 92 operationally connect in common to the output terminal of inverter 82. Input 3 terminal on NAND gate 94 operationally connects to the output terminal of inverter 84.

Output 0 terminal 96 of decoding circuit 66 operationally connects to the output terminal of NAND gate 86, output 1 terminal 98 thereof operationally connects to the output terminal of NAND gate 88, output 2 terminal 100 thereof operationally connects to the output terminal of NAND gate 90, output 3 terminal 102 thereof operationally connects to the output terminal of NAND gate 92, and output 4 terminal 104 thereof operationally connects to the output terminal of NAND gate 94.

A phase shift network means 106 for providing soft switch-on and switch-off of the lamp load therein by full-wave phase control of triacs 160, 162, 164, 166 and 168, as shown in FIG. 1, comprises first, second, third, fourth and fifth VACTEC LED/CdS-cell VTL 5C2 photoncouplers 108, 110, 112, 114 and 116 each having its number 2 LED anode terminal operationally connected through seventh, eighth, ninth, tenth and eleventh resistors 118, 120, 122, 124 and 126, respectively, to the 5-volt (D.C.) regulated control logic power supply 17, and each having its number 1 LED cathode terminals operationally connected to each of the output terminals 96, 98, 100, 102 and 104, respectively, from the decoder circuit 66. 12th, 13th, 14th, 15th and 16th resistors 140, 142, 144, 146 and 148, respectively, operationally connect at one end to number 3 terminal of each of the CdS cells of the photoncouplers 108, 110, 112, 114 and 116, respectively.

A lamp driver circuit 128 comprises first, second, third, fourth and fifth 300-volt, 8 amp triacs 160, 162, 164, 166 and 168 each having its main terminal 1 operationally connected to A.C. neutral terminal of the 120-volt (A.C.) power source.

A lamp display array 180 comprises first, second, third, fourth and fifth lamps 170, 172, 174, 176 and 178 each having its input terminal operationally connected to A.C. "hot" terminal of the 120-volt (A.C.) power source and each having its other terminal operationally connected to each of the main terminals 2 of the triacs 160, 162, 164, 166 and 168, respectively.

Triac gating terminals 130, 132, 134, 136 and 138 of each of the triacs 160, 162, 164, 166 and 168 of the lamp driver circuit 128 operationally connect to the other end of each of the resistors 140, 142, 144, 146 and 148, respectively, in the phase-shift network 106.

Number 5 terminals of each of the CdS-cells of photoncouplers 108, 110, 112, 114 and 116 in the phase-shift network 106 operationally connect to the other terminal of the first, second, third, fourth and fifth lamps 170, 172, 174, 176 and 178 of the lamp display array 180, respectively.

Figure 4:
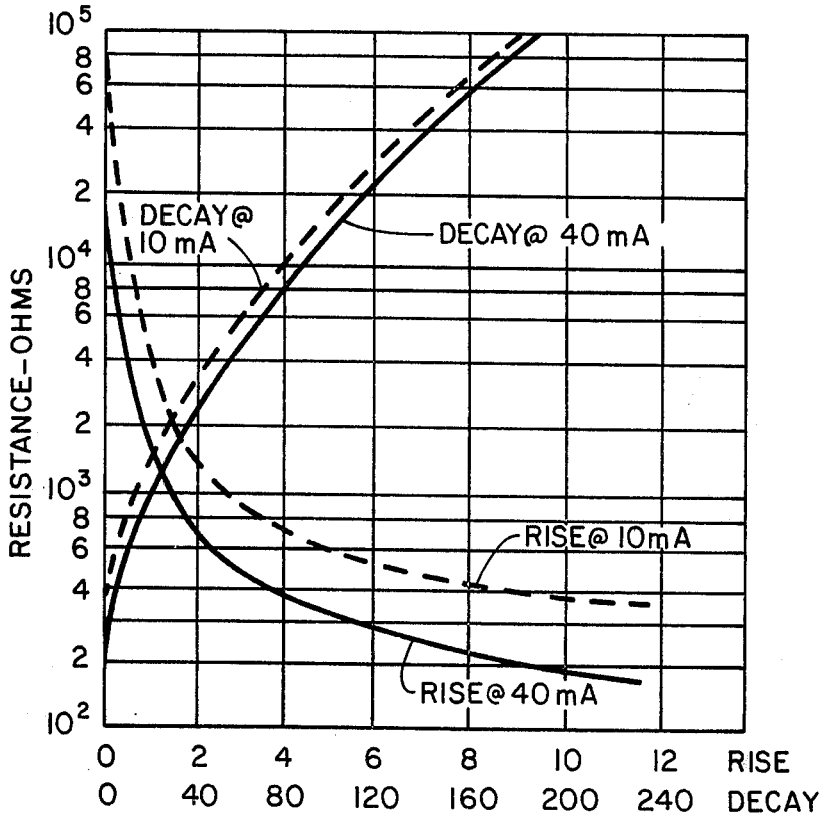
FIG. 4 shows a graph of the "decay" and "rise" resistance response time characteristics of the VACTEC photoncoupler VTL 5C2 after application or removal of light input.
Figure 5:
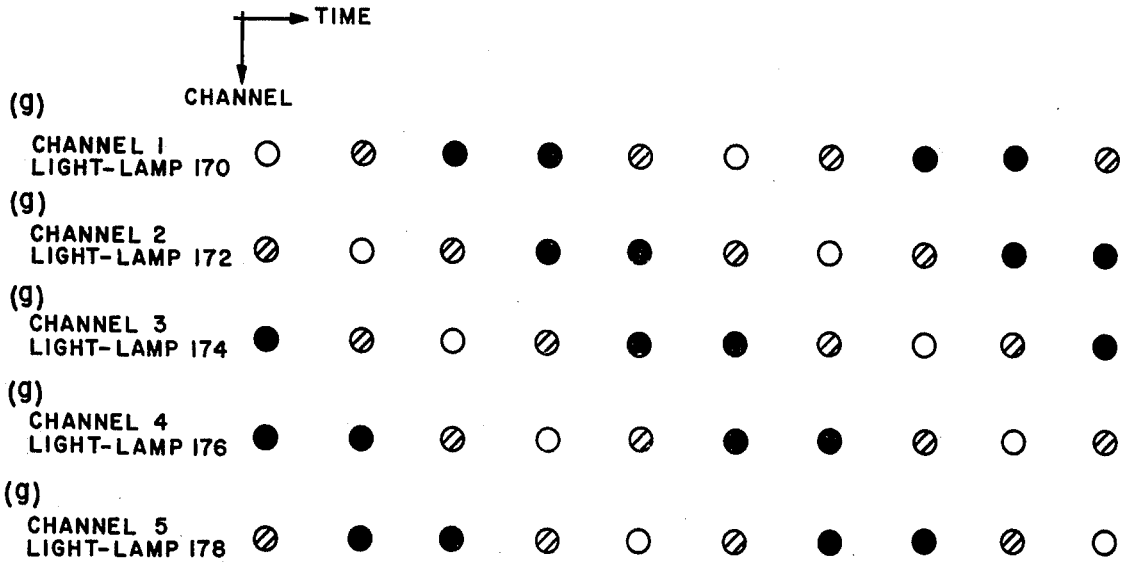
FIG. 5 (1, 2, 3, 4, 5) shows light intensity for each lamp of the chaser of FIG. 1 at various successive times on same A.C. cycle time basis as FIG. 3(*b*).

A mathematical expression of the "rise" of internal resistance of the photocell with time for the VACTEC photoncoupler VTL 5C2 after the application of input, as shown in FIG. 4, is:

$$R = (R_1 - R_o)e^{-\alpha_1 t + \alpha_2 t^2} + R_o \quad (1)$$

wherein typical values are:

$R_1$ = 100,000–1,000,000 ohms internal resistance of photocell at time zero, which value may range from 1,000–1,500,000 ohms.

$R_0$ = 100–1,000 ohms internal resistance of photocell after more than 10 milliseconds, which value may range from 10–10,000 ohms.

$\alpha_1$ = 0.910672–0.995657 first logarithmic decrement, which value may range from 0.50–1.50.

$\alpha_2$ = 0.0988440–0.141336 second logarithmic decrement, which value may range from 0.05–0.20.

$t$ = time, milliseconds.

A mathematical expression of the "decay" of internal resistance of the photocell with time for the VACTEC photoncoupler VTL 5C2 after the removal of input, as shown in FIG. 4, is:

$$R = (R_2 - R_o)e^{+\alpha_3 t + \alpha_4 t^2} + R_o \quad (2)$$

wherein typical values are:

$R_2$ = 1,000,000–10,000,000 ohms internal resistance of photocell after more than 240 milliseconds, which value may range from 500,000–15,000,000 ohms.

$R_o$ = 100–1,000 ohms internal resistance of photocell at time zero, which value may range from 10–10,000 ohms.

$\alpha_3$ = 0.032721–0.042911 first logarithmic increment, which value may range from 0.01–0.6.

$\alpha_4$ = 0.0001433–0.000398 second logarithmic increment, which value may range from 0.0005–0.00600.

$t$ = time, milliseconds.

OPERATION OF THE PREFERRED EMBODIMENT

When power is first applied to the light chaser, the current surges through capacitor 52 creating a voltage drop across resistor 54 and a level 1 to both inputs of NAND gate 56 of reset-to-zero circuit 51. As capacitor 52 charges, the current flow through it stops and the voltage drop across resistor 54 reduces to zero which disables the reset-to-zero circuit 51. After start-up, the pulses from clock 22, which are shown graphically in FIGS. 2(*b*) and 3(*b*), are input to the CP terminals of JK flip-flop 58 and RS flip-flop 62 in the counter 50. JK flip-flop 60 therein is operationally connected in the toggle mode. There is no synchronization between A.C. cycle time and clock 22 pulses. When resistor 40 is adjusted so that the clock pulse rate is 12 hz, one clock pulse comes out of clock 22 at terminal 49 for each roughly five full A.C. cycles input. The best clock pulse rate is 14 hz for a good "ripple" lighting effect.

Figure 3:
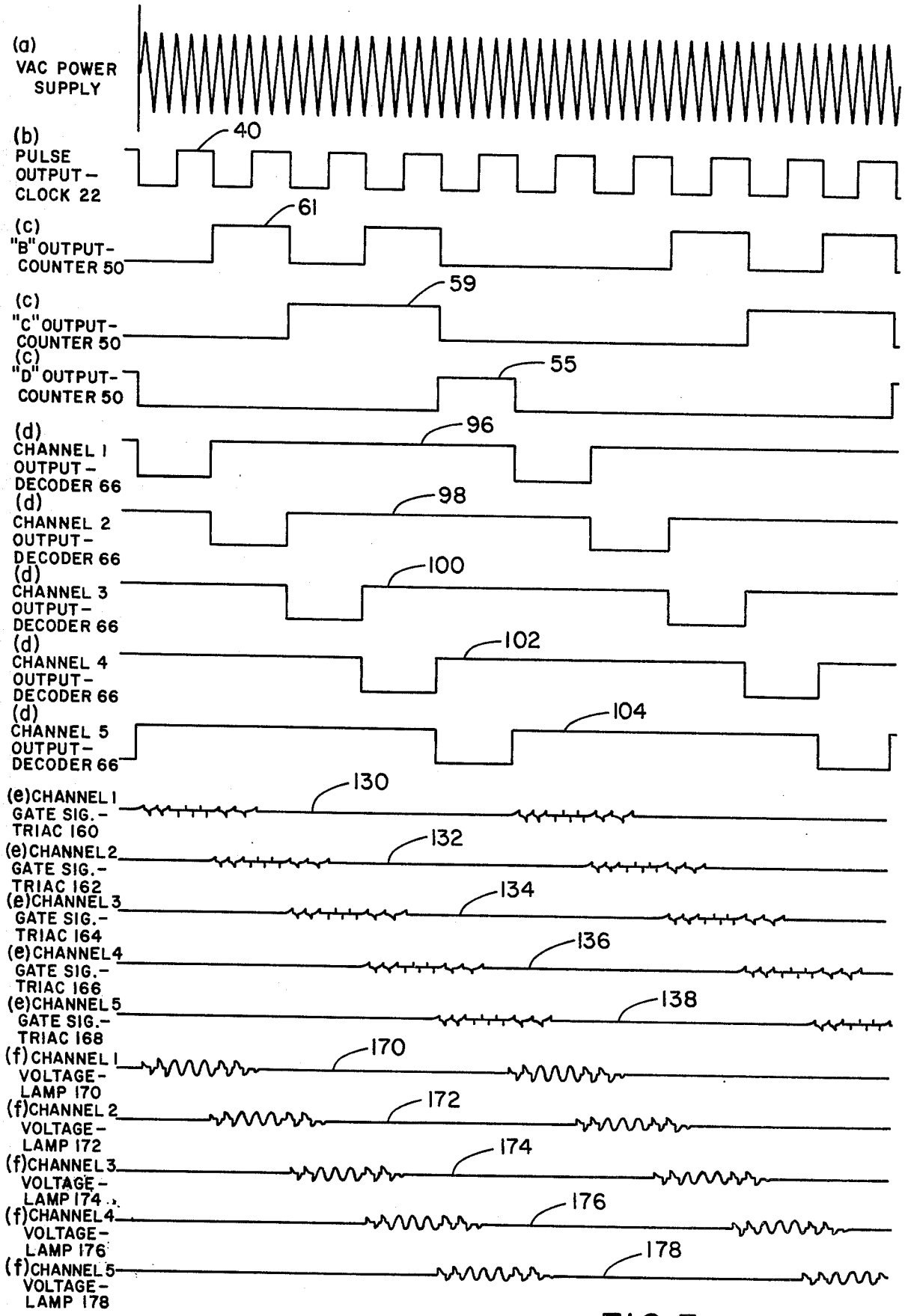
FIG. 3(*b*) shows pulse output from the clock of the control logic of FIG. 1 at a reduced A.C. cycle time basis over that of FIG. 2(*a*)

The counter 50 counts the pulses from clock 22 and outputs the count of said pulses on a time basis in 3-BIT binary code as logic levels on Q terminal 61 of JK flip-flop 58, on Q terminal 59 of JK flip-flop 60 and on D terminal 55 of RS flip-flop 62, as shown in FIG. 3 (*c* B,C,D). (The notation A, B, C, D is commonly used in the representation of an 8421 notation of a 4-BIT binary-coded decimal wherein flip-flop A counts units ($2^0 = 1$), flip-flop B counts twos ($2 = 2$), flip-flop C counts fours ($2^2 = 4$), and flip-flop D counts eights ($2^3 = 8$). Since in the logic of counter 50 only an 842 section of the 8421 notation is used (B, C, D), the logic signal chasing outputs from Q terminals 61 of JK flip-flop 58 and 59 of JK flip-flop 60 and D terminal 55 of RS flip-flop 62 represent a 0 to 4 count in 3-BIT binary-coded decimal logic, as shown in FIG. 3.)

Both JK flip-flops B and C, 58 and 60, respectively, have two inputs J and K and two outputs Q and $\overline{Q}$. If inputs $J = 0$ and $K = 1$ when the clock pulse to either one is received, its output will be $Q = 0$, $\overline{Q} = 1$ until the inputs change and a new clock pulse is received after the inputs J and K change. If inputs $J = 1$ and $K = 1$ when the clock pulse is received, the outputs Q and $\overline{Q}$ will be the opposite of what they were before the clock pulse.

With clock pulse input at $CP = 1$ from clock 22, the JK flip-flop B58, having its input already at $K = 1$, toggles each time it receives a 0 thereto. The J input of JK flip-flop B58 will be discussed later. Thus the output from JK flip-flop B58 divides the clock pulse train from clock 22 by 2. JK flip-flop B58 output is then used as clock input to the CP input of JK flip-flop C60, having its other inputs at $J = K = 1$. JK flip-flop C60 toggles each time it receives a CP input 0, as before, or half as often as JK flip-flop B58 did. Thus the output from JK flip-flop C60 again divides the preceding output pulse train from JK flip-flop B58 by 2.

Since this is a divide-by-5 counter, the counter must be reset to zero at the termination of each count of 5. To reset to zero, a pulse from clock 22 is used as the CP input to RS flip-flop D62. RS flip-flop D62 has its own D output as its R input, and its S input is the output from AND gate 64 which has both the Q outputs of JK flip-flop C60 and B58, respectively, as inputs. The $\overline{D}$ output of RS flip-flop D62 is used as the J input of JK flip-flop B58, and resets both JK flip-flops B and C, 58 and 60, and RS flip-flop D62 to zero after each count of 5.

The reset-to-zero circuit 51 starts all counters 50 at level 0 when power is applied because it is desirable to synchronize adjacent light chasers (not shown). Variable resistor 40 allows for adjustment of each clock 22 of all chasers to the same speed, overcoming differences caused by component tolerances.

The 3-BIT binary coded decimal output from the counter 50 is input to the BCD-to-decimal decoder 66. Operation of decoder 66 is as shown in the timing diagram of FIG. 3(*d* 1, 2, 3, 4, 5), wherein the digital format in the form of stepped voltage pulses repeats after each count of 5 is reached. Inverters 74, 76 and 78 provide NAND gates 86, 88, 90, 92 and 94 with the complemented BCD inputs, whereas inverters 80, 82 and 84 provide the same NAND gates with the uncomplemented BCD inputs, respectively. NAND gate 86 has as its inputs $\overline{A}$, $\overline{B}$ and $\overline{C}$. If any of these is zero, NAND gate 86 outputs one. If $\overline{A} = \overline{B} = \overline{C} = 1$, then NAND gate 86 will have its input conditions met and outputs a zero. All other NAND gates 88, 90, 92 and 94 output a one.

The time between pulses from clock 22 is 1/12 second (0.0833 sec.). The entire five channels 1, 2, 3, 4 and 5 are chased in 5/12 second (0.4167 sec.) assuming clock 22 is adjusted to 12 hz. This is the same time (0.4167 sec.) for 25 full A.C. cycles. The time between two gatings of each of channels 1, 2, 3, 4, 5 is 25 A.C. cycles, as shown in FIG. 3(*d* 1, 2, 3, 4, 5).

Figure 2:
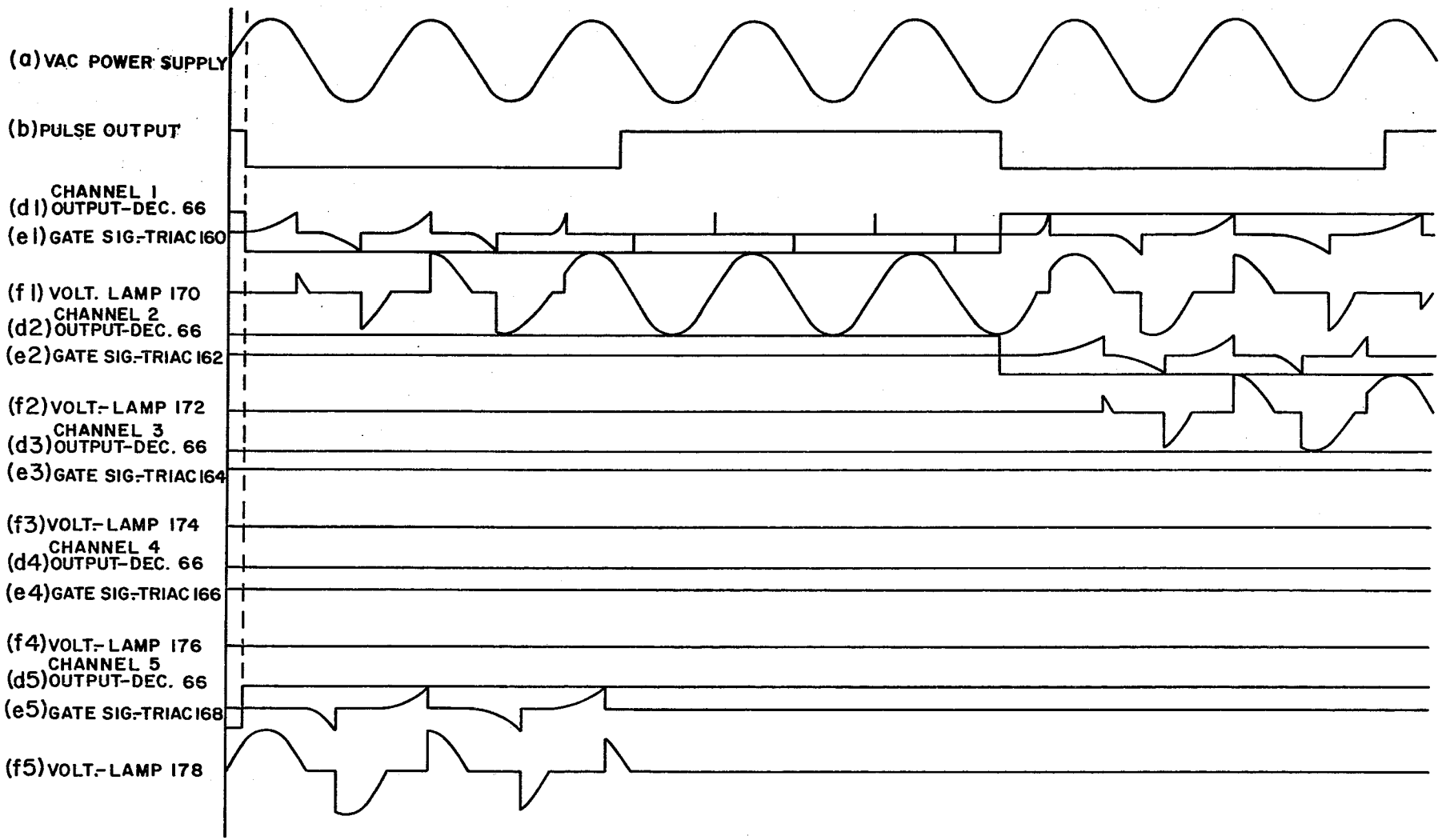
FIG. 2(*a*) shows the voltage waveform of the A.C. power supply to the chaser of FIG. 1.

In the operation of phase-shift network 106, the LED's of each of photoncouplers 108, 110, 112, 114 and 116 receive step voltage pulses from control logic power supply 17 along channels 1, 2, 3, 4, 5 through the outputs of decoder 66, as shown in FIGS. 2 and 3(*d* 1, 2, 3, 4, 5). The photocells of these photoncouplers respond to step-application or removal of light from LED's by slow "decay" or "rise" in their internal resistance, as shown in FIG. 4.

Triacs 160, 162, 164, 166 and 168 are gated when gate signal voltage for each reaches trigger level. All gate signals begin their "rise" at A.C. voltage crossover so that for soft switch-on, phase-shift begins at voltage crossover after the application of the D.C. voltage output pulse from decoder 66. The di/dt of the gate signal increases, as shown in FIGS. 3 and 3(*e* 1, 2, 3, 4, 5), as the "rise" characteristic of the photocell resistance falls off after step application of light, as shown in FIG. 4, from one half-cycle to the next until the *di/dt* approaches the infinite and full-wave phasing of the VAC applied to lamps 170, 172, 174, 176 and 178, respectively, is reached, as shown in FIGS. 2 and 3(*f* 1, 2, 3, 4, 5) and FIG. 3(*g*). For soft switch-off, phase-shift begins with the first increase in A.C. voltage crossover after the removal of a D.C. voltage pulse from decoder 66, and the di/dt of the gate signal decreases, as shown in FIGS. 2 and 3(*e* 1, 2, 3, 4, 5) as the "decay" characteristic of the photocell resistance rises after step-removal of light, as shown in FIG. 4, from one half-cycle to the next until the *di/dt* is zero and zero-wave phasing of the VAC applied to lamps 170, 172, 174, 176 and 178, respectively, is reached, as shown in FIGS. 2 and 3(*f* 1, 2, 3, 4, 5), and FIG. 3(*g*).

Although but one specific embodiment of this invention is herein shown and described, it will be understood that details of the construction shown may be altered or omitted without departing from the spirit of the invention as defined by the following claims.

I claim:

1. In a solid-state timer-stepper of the class wherein a pulse generator provides a train of incoming pulses to a counter which puts out BCD signals to a decoder for conversion into a digital format suitable for sequentially switching triacs arranged in multiple-segment load circuits, the combination with the gate circuits of said triacs of phase-shift network means having inputs electrically connected to the output from said decoder and outputs electrically connected to the gate circuits of said triacs for gating said triacs at increasing phase angles after application of the output from the decoder, and decreasing phase angles after removal of the output therefrom; whereby soft switching of the triacs is simulated.

2. In a solid-state timer-stepper, as set forth in claim 1, wherein the phase-shift network means comprises a photoncoupler having a diode electrically connected to the input to said phase-shift network means, and a photocell optically coupled with said diode and electrically connected to the output from said phase-shift network means having logarithmically decremental "rise" and "decay" internal resistance characteristics after application or removal of light, respectively, from the diode thereof.

3. In a solid-state timer-stepper, as set forth in claim 2, wherein the "rise" characteristic of the internal resistance of the photocell at time zero after application of light from the diode ranges from 1,000–1,500,000 ohms, and the "rise" internal resistance thereof after more than 10 milliseconds thereafter ranges from 10–10,000 ohms, and the first logarithmic decrement of resistance versus time after application of input ranges from 0.50–1.50 sec.$^{-1}$ and the second logarithmic decrement thereof ranges from 0.05–0.20 sec.$^{-2}$.

4. In a solid-state timer-stepper, as set forth in claim 2, wherein the "decay" characteristic of the internal resistance of the photocell at time zero after removal of light from the diode ranges from 10–10,000 ohms, and the "decay" internal resistance thereof after more than 240 seconds thereafter ranges from 500,000–15,000,000 ohms, and the first logarithmic increment of resistance versus time after removal of input ranges from 0.01–0.06 sec.$^{-1}$ and the second logarithmic increment thereof ranges from 0.00005–0.00600 sec.$^{-2}$.

5. In a solid-state timer-stepper including a control logic D.C. power supply and comprising a single phase, 120-volt A.C. power source; a clock timer circuit operationally connecting to the D.C. regulated control logic power supply of the power supply circuit a counter circuit operationally connected to the output terminal from said clock; a BCD decoder operationally connecting to output from said counter a phase shift network comprising first, second, third, fourth and fifth VACTEC LED/Cds-cell VTL 5c2 photon-couplers each having its Number 2 LED anode terminal operationally connecting through seventh, eighth, ninth, 10th and 11th resistors, respectively, to the 5-volt (D.C) regulated control logic power supply, and each having its Number 1 LED cathode terminals operationally connecting to each of the output terminals, respectively, from the decoder circuit; 12th, 13th, 14th, 15th and 16th resistors, respectively, operationally connecting at one end to Number 3 terminal of each of the CdS cells of the photoncouplers, respectively; a lamp driver circuit comprising first, second, third, fourth and fifth 300-volt, 8 amp triacs each having its main terminal 1 operationally connecting to A.C. neutral terminal of the 120-volt (A.C.) power source; a lamp display array comprising first, second, third, fourth and fifth lamps each having its input terminal operationally connecting to A.C. "hot" terminal of the 120-volt (A.C.) power source and each having its other terminal operationally connecting to each of the main terminals 2 of said triacs, respectively, and having triac gating terminals on each of said triacs operationally connecting to the other end of each of the resistors, respectively, and having Number 5 terminals of each of the CdS-cells of photoncouplers in the phase-shift network operationally connecting to the other terminal of the first, second, third, fourth and fifth lamps of the lamp display array, respectively.

* * * * *